US005573116A

United States Patent [19]

Zink

[11] Patent Number: 5,573,116

[45] Date of Patent: Nov. 12, 1996

[54] TOOL TRAY FOR ORGANIZING AND CARRYING SOCKETS

[76] Inventor: Paul D. Zink, 136 McConnell Ave., Wintersville, Ohio 43952

[21] Appl. No.: 345,743

[22] Filed: Nov. 22, 1994

[51] Int. Cl.[6] ..... B65D 85/28

[52] U.S. Cl. ..... 206/378; 206/377; 206/557; 211/70.6

[58] Field of Search ..... 206/372, 373, 206/374, 375, 376, 377, 378, 557; 211/70.6

[56] References Cited

U.S. PATENT DOCUMENTS

| | | | |
|---|---|---|---|
| D. 178,844 | 2/1956 | Evans | 206/373 |
| 1,365,682 | 6/1919 | Greist et al. . | |
| 1,712,473 | 5/1929 | McWethy . | |
| 4,058,210 | 11/1977 | Mitchell | 206/372 |
| 4,150,746 | 4/1979 | Buglione | 206/378 |
| 4,192,432 | 3/1980 | Jordan | 206/557 |
| 4,353,465 | 6/1981 | Rado . | |
| 4,714,158 | 9/1986 | Oltman . | |
| 4,927,020 | 5/1990 | Randy . | |
| 4,987,998 | 1/1991 | Tsai . | |
| 4,997,085 | 3/1991 | Brennan | 206/376 |
| 5,050,733 | 9/1991 | Brennan | 206/376 |
| 5,154,544 | 8/1991 | Arendt . | |
| 5,284,245 | 5/1993 | Slivon . | |
| 5,368,164 | 11/1994 | Bennett et al. | 206/376 |

FOREIGN PATENT DOCUMENTS 949040 9/1956 Germany .

*Primary Examiner*—David T. Fidei

[57] ABSTRACT

A tool tray for organizing and carrying sockets comprises a bottom wall; first and second side walls extending upwardly from the bottom wall; first and second end walls extending upwardly from the bottom wall; first and second handles secured respectively to the first and second end walls and disposed above the bottom wall; a plurality of rails disposed on the bottom wall; and a plurality of clips secured to each of the rails, the clips for removably securing the sockets. The first and second handles each includes a member for permitting a user to securely carry the tray with one hand. Convex shaped flanges are provided on the bottom surface of the bottom wall. A blank for forming the tool tray is also disclosed.

17 Claims, 3 Drawing Sheets

TOOL TRAY FOR ORGANIZING AND CARRYING SOCKETS

FIELD OF THE INVENTION

The present relates generally to a tool tray used by mechanics and the like to store sockets and particularly to a tool tray having a plurality of rails attached thereto and a plurality of clips secured to each rail for securing a plurality of sockets and a handle secured to each end of the tray to enable the user to carry the tray relatively comfortably with one hand.

BACKGROUND OF THE INVENTION

The master craftsman and technical maintenance personnel typically have over 200 sockets, drivers and attachments for a complete set of tools used in their line of work. Typically, the sockets are kept in a tray or drawer without any organization. Consequently, the user ends up spending unnecessary time in locating the appropriate socket during the course of his work.

Prior art tool tray typically has a longitudinally extending handle disposed above the tray. When carrying a loaded tray with one hand, one normally grasps the handle at the middle section, which at most cases would not be the center of gravity. A stress is consequently imposed on the wrist which tries to counteract the twisting effect of the center of gravity of the loaded tray.

Prior art tray typically has a flat bottom. When work is done underneath a vehicle, the tray is typically placed on the concrete floor and is dragged around as the user changes position to place the tray next to him for easy access to the sockets. Since the tray presents a flat surface to the floor and is weighed down with the sockets, generating a relatively high coefficient of friction, it would be relatively harder to move the tray around.

There is, therefore, a need for a socket tool tray that organizes the sockets and saves valuable time for the user, relatively easy to handle with one hand and relatively easy to drag around on the concrete floor.

OBJECTS AND SUMMARY OF THE INVENTION

It is an object of the present invention to provide a tool tray for organizing and carrying a mechanic's sockets.

It is another object of the present invention to provide a tool tray that keeps the sockets organized to provide a ready visual determination whether any sockets are missing.

It is still another object of the present invention to provide a tool tray that organizes the sockets and maximizes storage space.

It is yet another object of the present invention to provide a tool tray that keeps the sockets tightly secured and immobile to the tray.

It is still another object of the present invention to provide a tool tray that organizes the sockets in a specific order such that the user can readily find the right socket all the time, thereby minimizing wasted time in locating a socket in an unorganized tray.

It is another object of the present invention to provide a tool tray with a handle at each end designed to enable a user to transport the tray with one hand, thereby freeing the other hand for handling other items.

It is still another object of the present invention to provide a tool tray that is relatively easy to drag around on a concrete floor.

It is yet another object of the present invention to provide a tool tray that is relatively inexpensive to manufacture.

In summary, the present invention provides a tool tray for organizing and carrying sockets. The tray comprises a bottom wall; first and second side walls extending upwardly from the bottom wall; first and second end walls extending upwardly from the bottom wall; first and second handles secured respectively to the first and second end walls and disposed above the bottom wall; a plurality of rails disposed on the bottom wall; and a plurality of clips secured to each of the rails, the clips for removably securing the sockets. The first and second handles each includes a member for permitting a user to securely carry the tray with one hand. Convex shaped flanges are provided on the bottom surface of the bottom wall for permitting relative ease of dragging the tray on a concrete floor.

The present invention also provides a blank for forming the tool tray.

These and other objects of the present invention will become apparent from the following detailed description.

DETAILED DESCRIPTIONS OF THE DRAWINGS

DETAILED DESCRIPTION OF THE INVENTION

Figure 1:
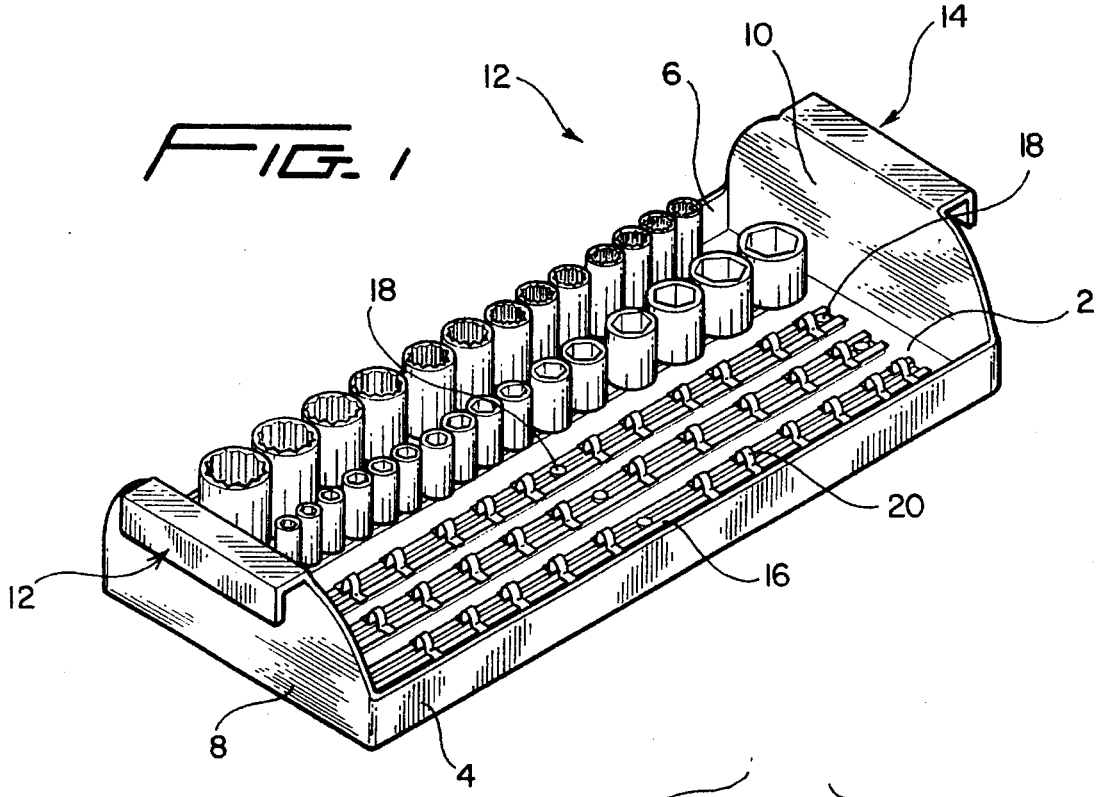
FIG. 1 is a top perspective view of a tool tray made in accordance with the present invention.

A tool tray R made in accordance with the present invention is disclosed in FIG. 1. The tray R comprises a bottom wall 2, side walls 4 and 6 and end walls 8 and 10 extending upwardly from the bottom wall 2, as best shown in FIG. 1. Handles 12 and 14 are secured to respective end walls 8 and 10.

Figure 2:
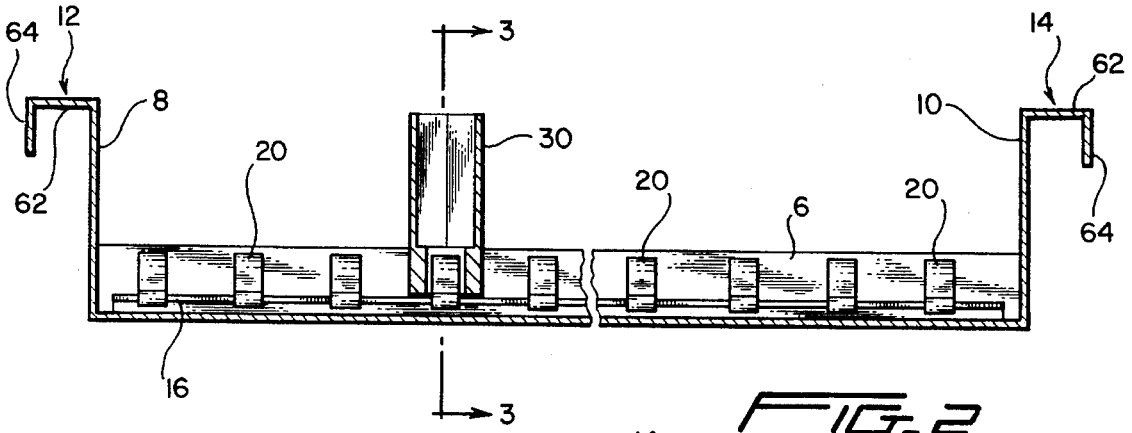
FIG. 2 is a longitudinal cross-sectional view of the tray of FIG. 1.
Figure 3:
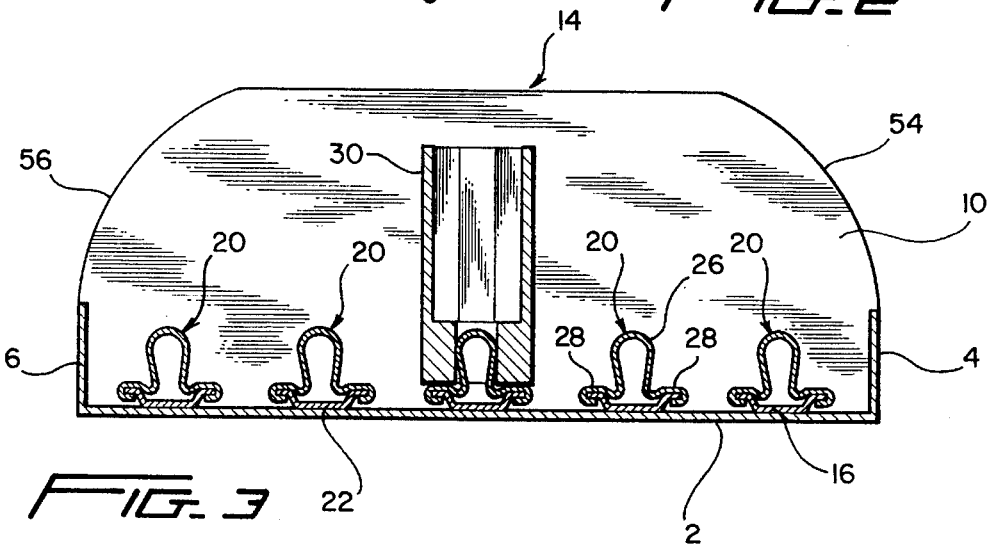
FIG. 3 is a cross-sectional view taken along line 3—3 of FIG. 2.

A plurality of rails 16 are rigidly secured to the bottom wall 2 parallel to the longitudinal axis of the bottom wall 2, as best shown in FIGS. 1, 2, and 3. Connectors such as pop rivet assemblies 18 are used to secure the rails 16 to the bottom wall 2. Other securing means such as spot welding, screws, etc. may be used to fasten the rails 16 to the bottom wall 2. A plurality of clips 20 are slidably and frictionally secured to each rail 16, as best shown in FIGS. 1, 2, and 3.

Figure 4:
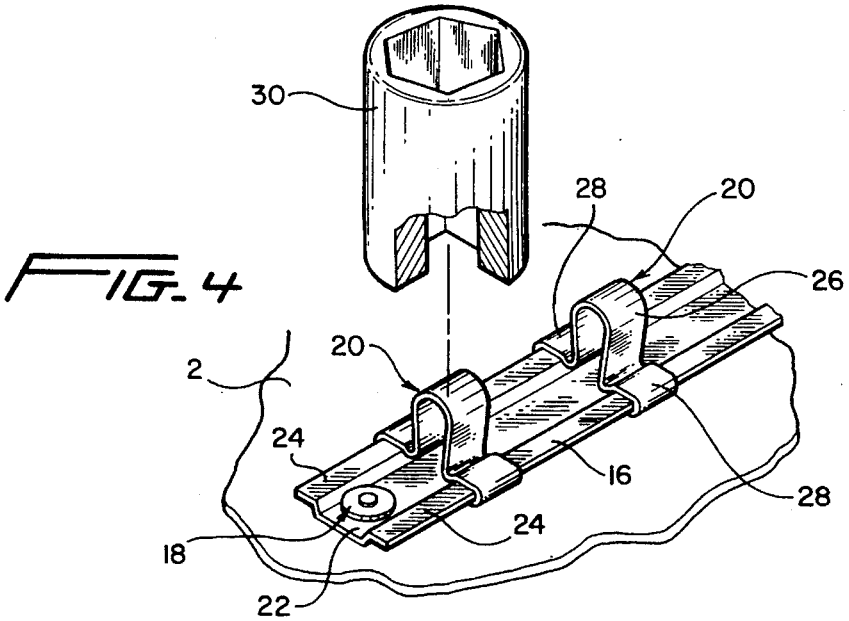
FIG. 4 is a fragmentary perspective view of a rail and several clips used in the present invention to hold the sockets in the tray.

Each of the rail 16 has a bight portion 22 and a pair of outwardly extending wings 24, as best shown in FIG. 4. Each of the clips 20 includes a central inverted U-shape portion 26 and a pair of C-shaped wings 28 that are frictionally and slidably secured to the respective wings 24 of the rails 16. Each portion 26 is adapted to resiliently receive a socket 30, as best shown in FIGS. 2, 3 and 4.

Figure 5:
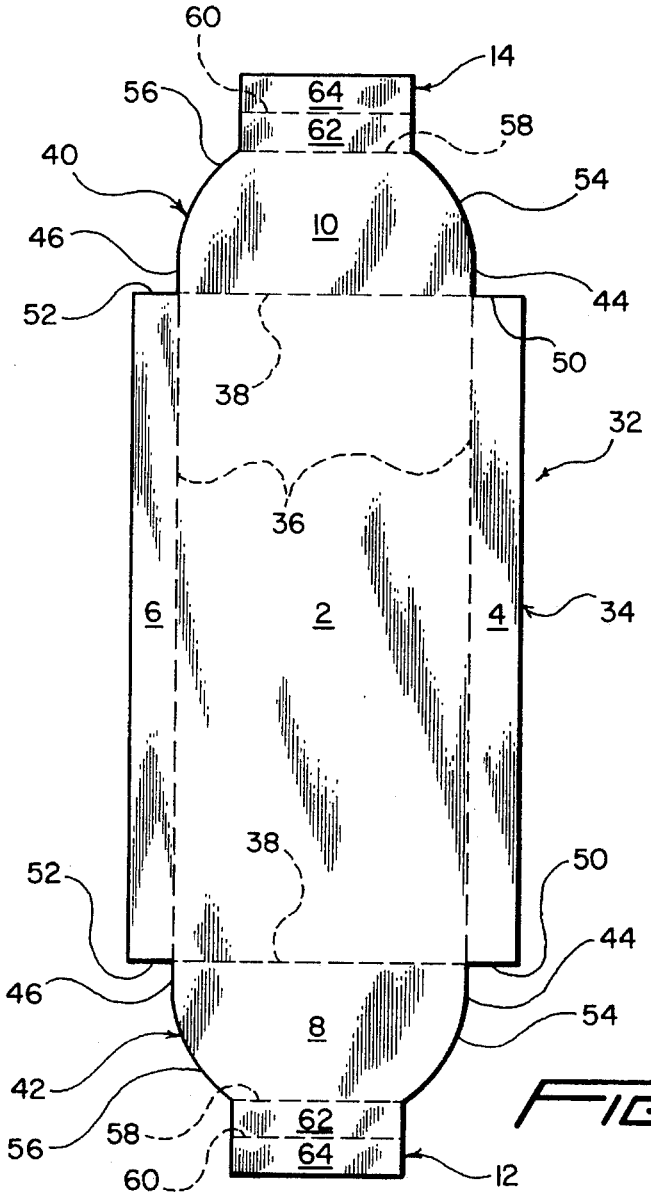
FIG. 5 is a plan view of a blank sheet prior to bending to form the tray of FIG. 1.
Figure 9:
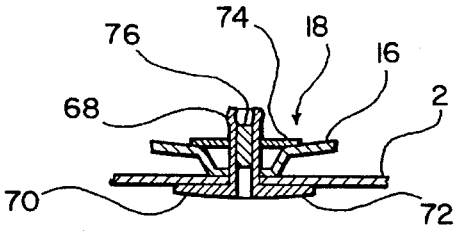
FIG. 9 is an enlarged cross sectional view of a pop rivet assembly used in the present invention.

The tray R is made by bending a blank 32 made of standard galvanized sheet metal of 18 gauge steel, as best shown in FIG. 5. For heavy duty application, a 16 gauge steel or thicker may be used. The blank 32 has a rectangular middle section 34 which includes the bottom wall 2 and the side walls 4 and 6 delineated by broken lines 36 and 38 which indicate bend lines when the tray R is formed. The bottom wall 2 and the side walls 4 and 6 are preferably rectangular in shape.

Figure 6:
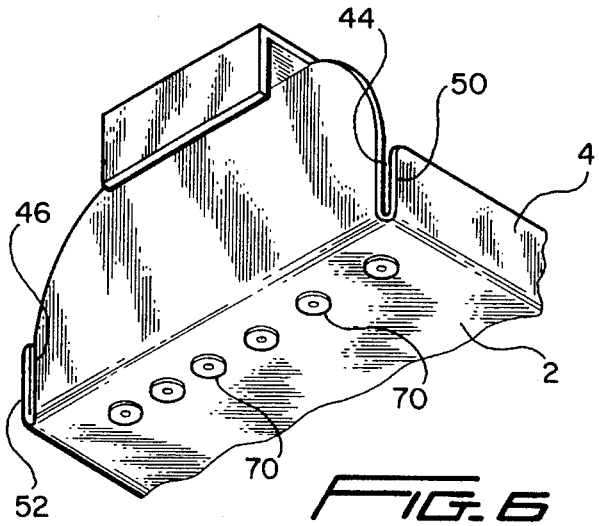
FIG. 6 is a fragmentary bottom perspective view of one end of the tray of FIG. 1.

The blank 32 includes end sections 40 and 42 comprising the respective end walls 8 and. 10 and handles 12 and 14, as best shown in FIG. 5. Each end section 8 and 10 tapers inwardly as it extends from the middle section 34. Each end section 8 and 10 includes straight outer edges 44 and 46 that are substantially perpendicular to the adjacent shorter outer edges 50 and 52 of the respective end wall sections 4 and 6 such that these edges will line up substantially parallel to each other when the blank 32 is bent into the tray R, as best shown in FIG. 6. The broken lines 38 define the bend lines for the end portions 40 and 42 when they are bent to form the end walls 8 and 10. The end sections 40 and 42 includes convex outer edges 54 and 56 that terminate into the respective handles 12 and 14 as the end sections 8 and 10 taper from wide to narrow. Broken lines 58 and 60 define the bend lines when the handles 12 and 14 are formed from the blank 32. The bend lines 38, and 60 are substantially parallel to each other. The bend lines 36 are also parallel to each other and define a rectangle with the bend lines 38.

Each of the handles 12 and 14 includes a member 62 disposed substantially transversely and away from the respective side walls 8 and 10. Each handle 12 and 14 also includes a member 64 disposed substantially transversely and downwardly from the respective member 62, as best shown in FIG. 2. Each handle 12 and 14 thus forms a substantially "L"-shaped configuration in cross-section, as best shown in FIG. 2.

Figure 8:
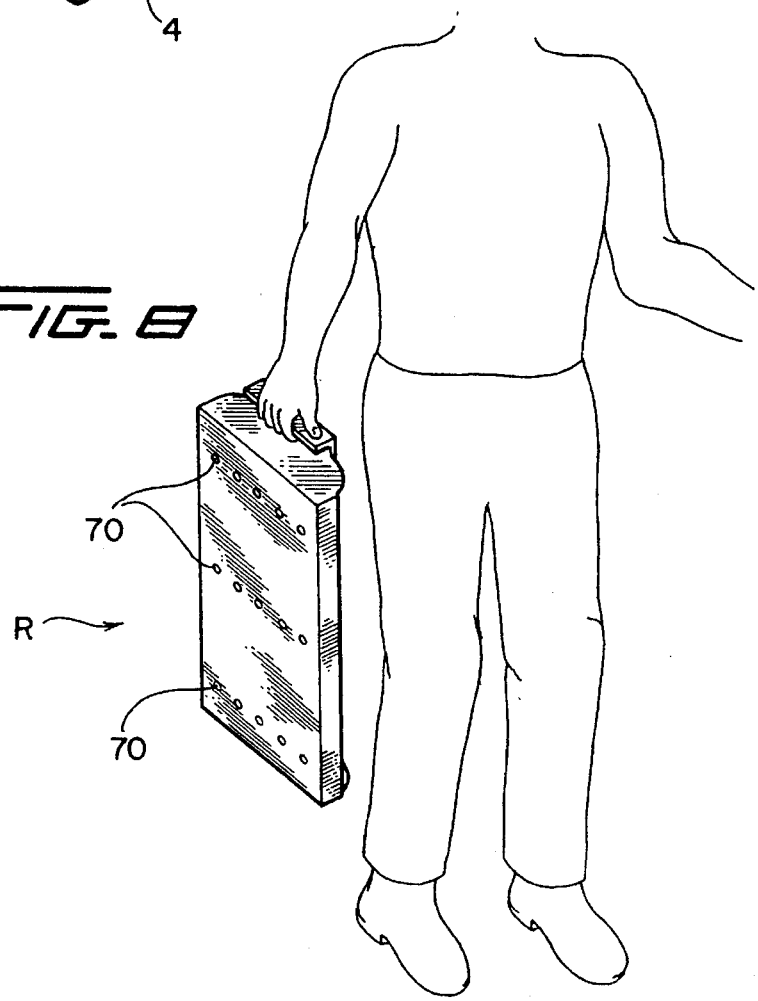
FIG. 8 is a perspective view of the tray of FIG. 1 being transported with one hand.
Figure 7:
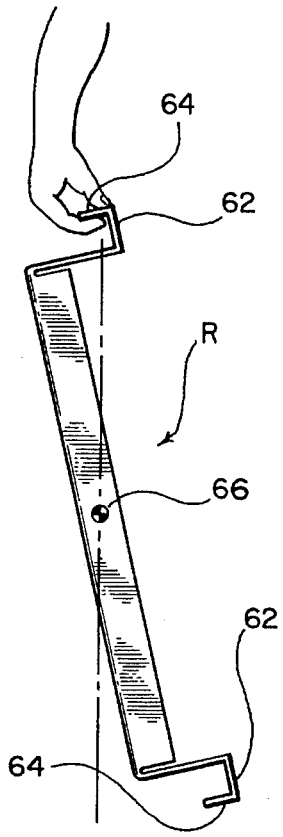
FIG. 7 is a side elevational view of the tray of FIG. 1 shown in its natural equilibrium position when being transported with one hand.

The tray R has a center of gravity 66 that is advantageously below the handles 12 and 14 when the tray R is disposed horizontally on a flat surface. The handles 12 and 14 are disposed substantially above the bottom wall 2 such that when the tray R is carried with one hand by one of the handles 12 and 14, the longitudinal axis of the tray R will tip from the vertical so that the center of gravity 66 is directly below the user's hand, thereby making the member 64 slightly off the horizontal and downwardly from the member 62 to permit easier carrying of the tray R, as best shown in FIGS. 7 and 8. Handles 12 and 14 therefore advantageously provides means for handling the tray with one hand with relative ease or with two hands if desired.

Each of the pop rivet assemblies 18 includes a sleeve 68 and a flange 70 at one end of the sleeve. The flange 70 has a convex surface 72 that advantageously permits the tray R to glide relatively easily on a concrete floor. The sleeve 68 protrudes through aligned holes on the base wall 2 and rail 16. A washer 74 presses down on the rail 16 and is locked in place by an expanded rod 76 that is forcibly pressed inside sleeve 68, thereby locking the washer 74 in place. With the use of the pop rivet assemblies 18, a plurality of convex washers 70 are thereby provided on the bottom of the tray R, thereby advantageously providing a plurality of feet on which the tray R can be easily dragged about on a concrete floor. The pop rivet assemblies 18 are preferably made from aluminum or other suitable material. The washer 20, being made from aluminum, would advantageously provide durability when the tray R is placed on a concrete floor while the mechanic works underneath the vehicle.

The sidewalls 4 and 6 and the end walls 10 and 8 being disposed transversely to the bottom wall 2 advantageously provide rigidity and strength to enable the tray R to hold a complete set of sockets, which could weigh several hundred pounds, depending on the size of the tray R, without deforming. The corner edges 44 and 50, and 46 and 52 may be left open without welding, as best shown in FIG. 6, or they may be welded together for additional strength. If welding is not used, then the galvanized plating on the sheet metal will not have to be touched up with paint or any other means, thereby saving manufacturing time.

The rails 16 are arranged along the longitudinal axis parallel to the longer side of the rectangle of the base wall 2 and parallel to each other. Each rail 16 may be assigned to secure one specific set of sockets of a certain size drive, such as ¼, ⅜ or ½ inch drives. The tall sockets may be arranged along the rails disposed substantially along the longitudinal center along the bottom wall 2. The tall sockets would preferably be disposed below the handles 12 and 14 as best shown in FIG. 3.

The tray R may be organized such that the sockets arranged on each rail 16 is dedicated to sockets having the same drive size and that the sockets progress across the width of the tray from the smallest drive to the biggest drive. In this manner, the rails 16 may be spaced unevenly across the width of the tray R, the spacing increasing in distance as rails 16 are assigned with sockets of larger drives. This arrangement advantageously maximizes the storage capacity of the tray R.

In operation, the tray R is used to organize the sockets 30 in any manner desirable to the user. For example, the user may allocate one or more adjacent rails for sockets of one size, the next adjacent rail being for sockets of the next higher size and so forth. Organized in this manner, the user is readily provided with a visual indication when he is missing a socket, thereby avoiding wasted valuable time rummaging through an unorganized tray for the missing socket. In addition, the user is quickly able to select a particular socket for his use. With the provision of the convex flange 70, the tray R loaded with the sockets 30 could be relatively easily dragged on the concrete floor with ease to any location adjacent to the user as he works underneath the vehicle.

To transport the tray R from its storage cabinet to the work site, carrying the tray R with one hand would be sufficient, as best shown in FIG. 7, due to the advantageous location of the handles 12 and 14 that make the tray tilt from the vertical such that the member 64 provides a secure grip hold. The member 64 will not inadvertently slip out of the hand, since it is directed downwardly into the carrying hand, as best shown in FIG. 7.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

I claim:

1. A tool tray for organizing and carrying sockets, comprising:

a) a bottom wall;

b) first and second side walls extending upwardly from said bottom wall;

c) first and second end walls extending upwardly from said bottom wall;

d) first and second handles secured respectively to said first and second end walls and disposed above said bottom wall;

e) said first and second handles each including a member for permitting a user to securely carry said tray with one hand;

f) a plurality of rails disposed on said bottom wall, said rails are disposed parallel to each other; and g) a plurality of clips secured to each of said rails, said clips for removably securing the sockets.

2. A tool tray, as in claim 1, wherein:

a) each of said first and second handles is substantially "L"-shaped in cross-section.

3. A tool tray, as in claim 1, wherein:

a) each of said first and second handles includes a first member extending away from the respective first and second end walls; and b) a second member extending from the respective first member.

4. A tool tray, as in claim 1, wherein:

a) the center of gravity of said tray is disposed such that a vertical line from a user's hand holding one of said first and second handles through the center of gravity intersects said base wall or an-extension thereof downwardly from the user's hand.

5. A tool tray, as in claim 3, wherein:

a) said second member is disposed downwardly toward the user's hand holding one of said first and second handles when said tray is being carried in one hand.

6. A tool tray, as in claim 1, wherein:

a) said base, side and end walls are integral.

7. A tool tray, as in claim 1, wherein:

a) said side and end walls are disposed transversely to said base wall.

8. A tool tray, as in claim 1, wherein:

a) said end walls are higher than said side walls.

9. A tool tray for organizing and carrying sockets, comprising:

a) a bottom wall;

b) first and second side walls extending upwardly from said bottom wall;

c) first and second end walls extending upwardly from said bottom wall;

d) first and second handles secured respectively to said first and second end walls and disposed above said bottom wall;

e) a plurality of rails disposed on said bottom wall;

f) a plurality of clips secured to each of said rails, said clips for removably securing the sockets;

g) a plurality of connectors operably secured to said rails and said bottom wall for securing said rails to said bottom wall; and h) said connectors each including a flange disposed below said bottom wall for supporting said bottom wall above a surface.

10. A tool tray, as in claim 9, wherein:

a) said connectors each includes an expandable sleeve integral with said flange;

b) said sleeve extending through said bottom wall and respective rail; and c) an oversized member disposed within said sleeve for expanding said sleeve to lock said sleeve with the respective rail and said bottom wall.

11. A tool tray, as in claim 9, wherein:

a) said connectors each includes an expandable sleeve integral with said flange;

b) said sleeve extending through said bottom wall and respective rail;

c) a washer engaging the respective rail; and d) an oversized member disposed within said sleeve for expanding said sleeve to lock said sleeve with said washer.

12. A tool tray, as in claim 9, wherein:

a) said flange includes a convex surface disposed toward the ground.

13. A tool tray, as in claim 9, wherein:

a) said bottom wall includes a longitudinal axis; and b) said rails are disposed parallel to said longitudinal axis.

14. A tool tray, as in claim 9, wherein:

a) said rails are disposed unevenly across the width of said bottom wall.

15. A tool tray for organizing and carrying sockets, comprising:

a) a bottom wall;

b) first and second side walls extending upwardly from said bottom wall;

c) first and second end walls extending upwardly from said bottom wall;

d) first and second handles secured respectively to said first and second end walls and disposed above said bottom wall;

e) said first and second handles each including a member for permitting a user to securely carry said tray with one hand;

f) the center of gravity of said tray is disposed such that a vertical line from a user's hand holding one of said first and second handles through the center of gravity intersects said base wall or an extension thereof downwardly from the user's hand;

g) a plurality of rails disposed on said bottom wall; and h) a plurality of clips secured to each of said rails, said clips for removably securing the sockets.

16. A tool tray, as in claim 15, wherein:

a) each of said first and second handles is substantially "U"-shaped in cross-section.

17. A tool tray, as in claim 15, wherein:

a) each of said first and second handles includes a first member extending away from the respective first and second end walls; and b) a second member extending from the respective first member.

* * * * *